United States Patent [19]

Sampson et al.

[11] Patent Number: 4,987,705

[45] Date of Patent: Jan. 29, 1991

[54] SKYLIGHT CONSTRUCTION

[75] Inventors: Robert Sampson, Sanford; Sean Flanigan, Wells, both of Me.

[73] Assignee: Wasco Products, Inc., Sanford, Me.

[21] Appl. No.: 283,731

[22] Filed: Dec. 13, 1988

[51] Int. Cl.[5] ..... E04B 7/18

[52] U.S. Cl. ..... 52/72; 52/200; 49/483

[58] Field of Search ..... 52/200, 72, 403, 397; 49/485, 495, DIG. 1, 475

[56] References Cited

U.S. PATENT DOCUMENTS 3,788,013 1/1974 Veen, Jr. ..... 52/200

4,449,340 5/1984 Jentoft et al. ..... 52/200

4,570,393 2/1986 Minter ..... 52/200

4,776,141 10/1988 Powell ..... 52/200

*Primary Examiner*—Carl D. Friedman

*Assistant Examiner*—Caroline D. Dennison

*Attorney, Agent, or Firm*—Wolf, Greenfield & Sacks

[57] ABSTRACT

A skylight adapted to fit within the opening of a roof or the like having a peripheral curb frame which is fixed to the roof about the opening. The frame is constructed of a plastic material and includes a retainer for securing the skylight cover over the curb frame. A header gasket is provided between the curb frame and retainer and interlocks respectively therewith.

26 Claims, 4 Drawing Sheets

34
22
56
17
18
16
2
36
28
25
14
52
50
51
44
20
60
118
11A
40
11
10

FIG. 4
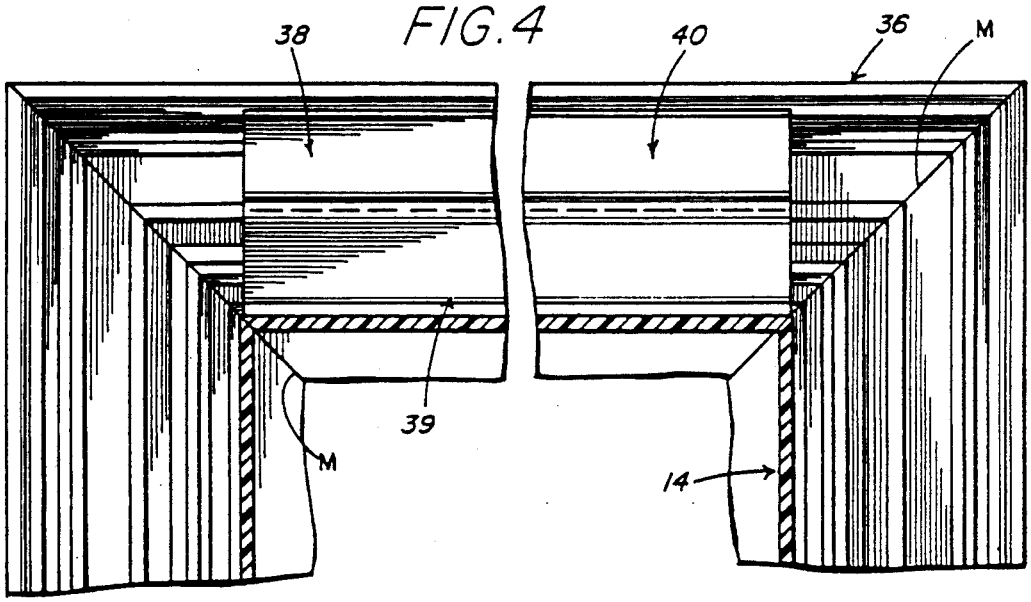
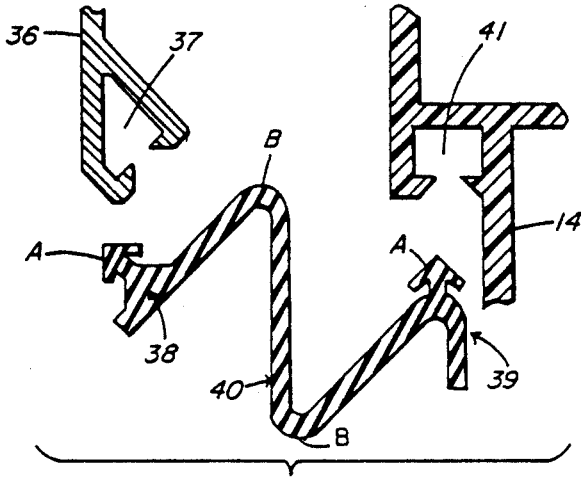
FIG. 5
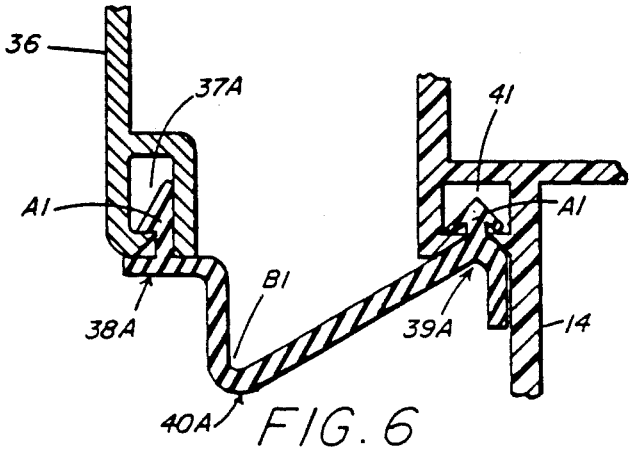
FIG. 6

SKYLIGHT CONSTRUCTION

BACKGROUND OF THE INVENTION

1. Field of the Invention

The present invention relates in general to an improved skylight construction and is concerned, more particularly, with an improved skylight construction preferably formed of a co-extruded plastic material, thus adapting itself to simplified manufacture and having improved temperature resistant and weathering properties. Even more particularly, the present invention pertains to an improved gasket construction for a skylight.

2. Background Discussion

A skylight construction is shown, by way of example, in U.S. Pat. No. 4,449,340, granted May 22, 1984 and owned by the present assignee herein. This skylight construction is of plastic, including a frame that is comprised of a base frame and an operating leaf frame. A retainer that may be constructed of a lightweight metal material is typically employed for holding the glazing to the base frame. Gasketing is typically provided between the glazing and the frame as well as between the frame components.

It has been found that, particularly on steep-pitched roofs, and particularly under adverse rain conditions, that leakage may occur through the gasketing, particularly along the side of the skylight at the top side thereof on a slanted roof.

Accordingly, it is an object of the present invention to provide an improved gasket construction that is adapted to alleviate leakage problems that may occur through the usual gasketing employed in a skylight.

Another object of the present invention is to provide an improved skylight construction, and in particular a skylight construction having an improved gasket arrangement that assists in blockage and diversion of water, particularly at the top side of the skylight, and particularly under conditions of intense streams of water directed at the skylight, as might occur in a torrential downpour.

Still another object of the present invention is to provide an improved skylight construction having a water blocking and diverting gasket, also referred to herein as a header gasket, preferably coupled between the skylight retainer and a curb frame, and preferably constructed for interlocking respectively therebetween.

SUMMARY OF THE INVENTION

To accomplish the foregoing and other objects of this invention, there is provided a skylight construction adapted to be fitted into an opening in a building such as either a commercial building or a residential building. The skylight construction comprises a frame means that is of plastic construction, such as constructed of extruded PVC. The frame means, or curb frame, extends about the opening and includes means for the securing thereof about the opening. The skylight construction also includes a translucent or transparent means covering the opening and extending at its edges to overlie the curb frame. The covering means may comprise one or more glazing panels, or may also be in the form of one or more plastic domes. A retainer extends about the periphery of the skylight for holding the glazing on the curb frame.

In the particular embodiment described herein, the curb frame is comprised of a base frame and an operating leaf frame overlying the base frame. However, the principles of the present invention may be employed in connection with either a single part or two-part curb frame. The curb frame is constructed of a rigid plastic profile having high temperature resistant properties and preferably having integral therewith and coextruded therewith a flexible sealing flange.

In accordance with the present invention, a header gasket is provided and may be disposed only at the top side of the skylight as installed on a slanted roof. The header gasket has a foldable center section and interlocking ends adapted to interlock, respectively, with the curb frame and retainer. The foldable section of the gasket enables the gasket to maintain its position in an operable skylight construction even when the skylight is opened and closed. The header gasket seals and assists in diverting water away from the skylight and prevents torrents of water from entering inside of the retainer and causing internal leakage at or about the skylight curb frame.

BRIEF DESCRIPTION OF THE DRAWINGS

Numerous other objects, features and advantages of the invention will now become apparent upon a reading of the following detailed description taken in conjunction with the accompanying drawings, in which:

FIG. 4 is a cross-sectional view taken along line 4—4 of FIG. 2;

FIG. 5 separately illustrates the detailed construction of the preferred form of header gasket in accordance with the present invention; and FIG. 6 illustrates in cross-sectional detail an alternate construction for the header gasket and alternate construction of the retainer for receiving the header gasket.

DETAILED DESCRIPTION

Figure 1:
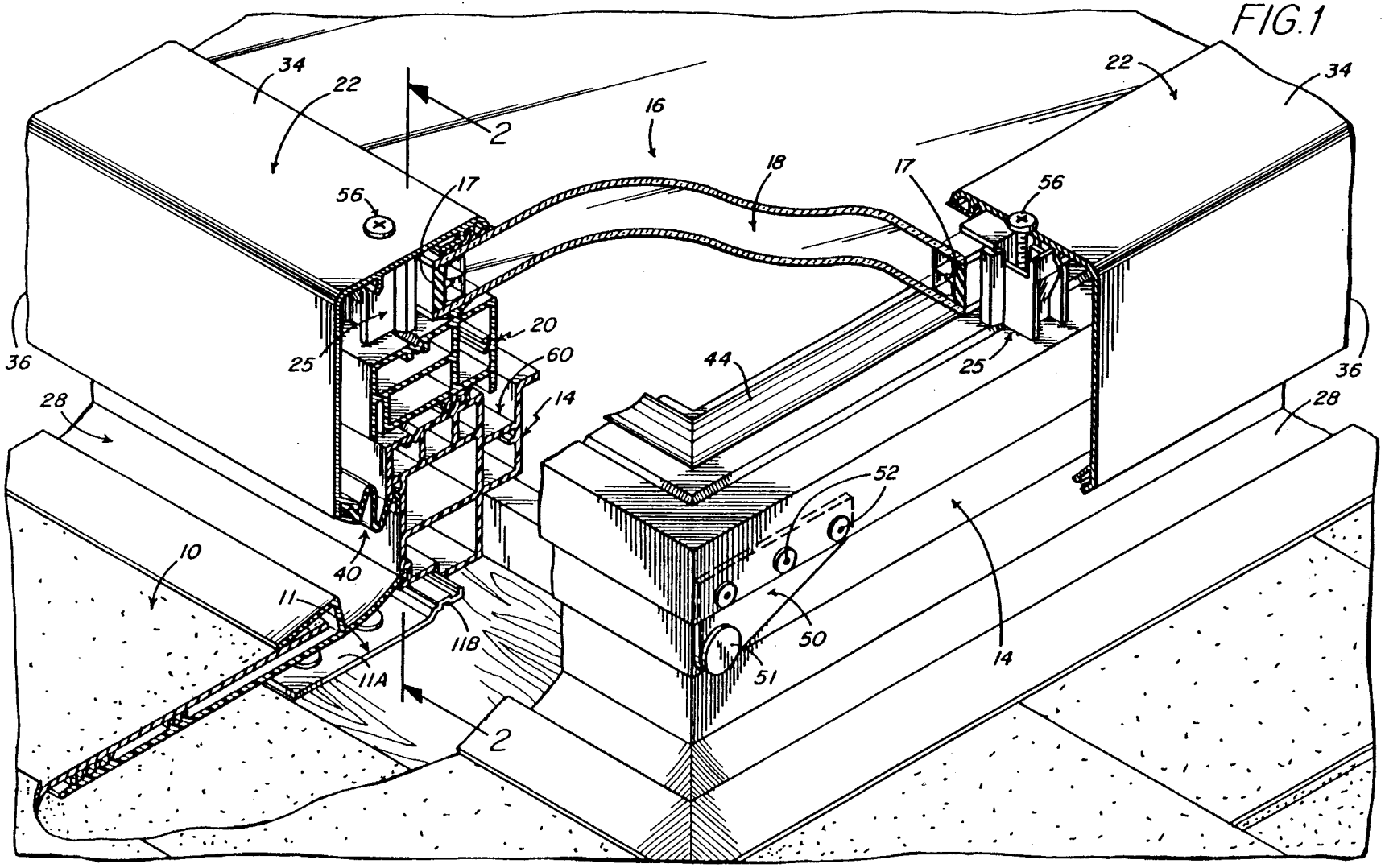
FIG. 1 is a perspective view, partially cut away, and illustrating a skylight construction in accordance with the present invention.
Figure 2:
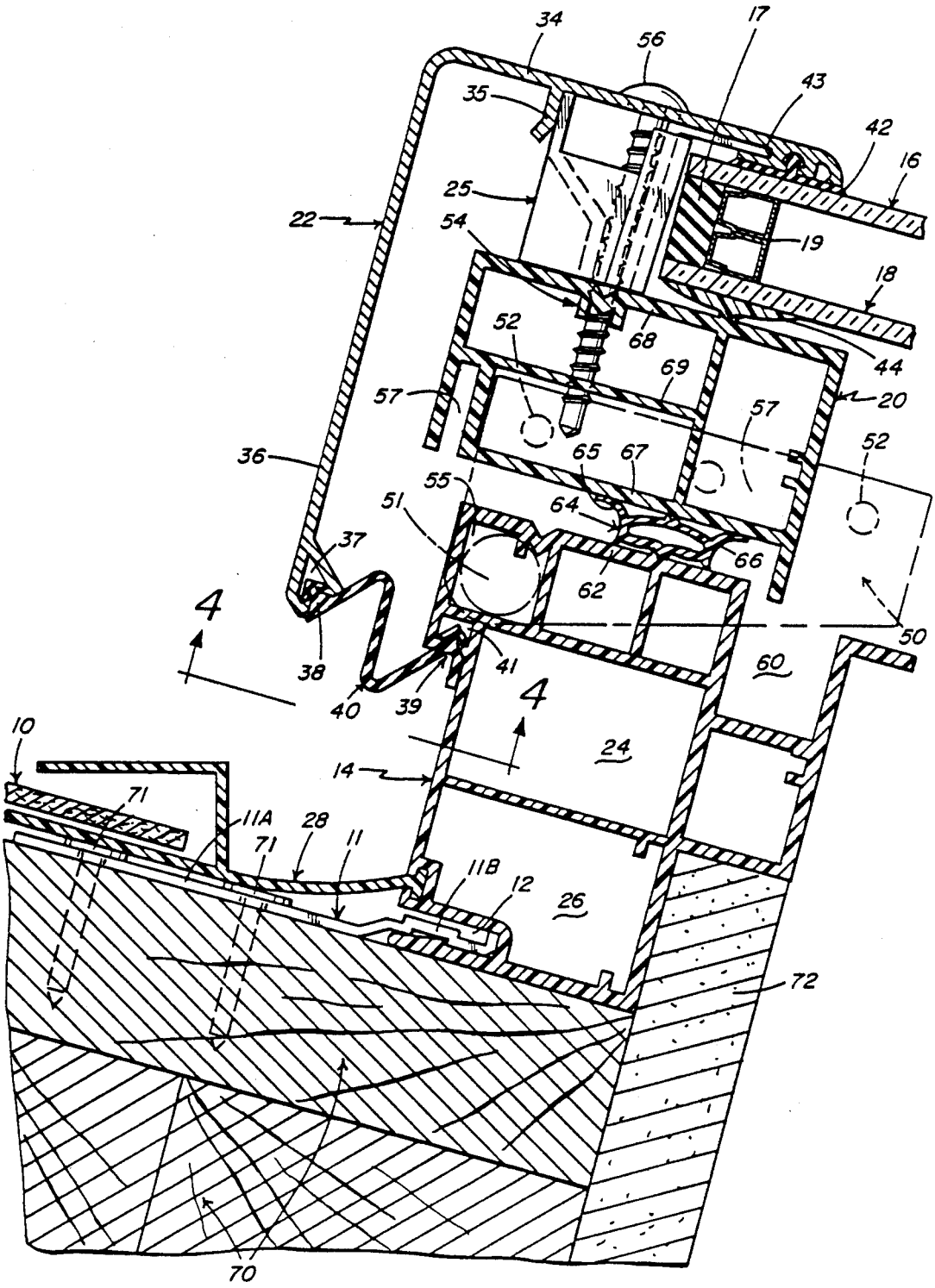
FIG. 2 is a cross-sectional view taken along line 2—2 of FIG. 1 and showing further cross-sectional details of the skylight construction.

Reference is now made to a skylight construction as illustrated in the cut-away perspective view of FIG. 1 and the cross-sectional view of FIG. 2 In the embodiment illustrated herein in FIGS. 1 and 2, the skylight is of a flat construction, having flat glazing panels. However, in alternate constructions, a domed type of skylight may also be employed. The skylight is adapted to span an opening which is generally of square or rectangular shape and the opening may be defined by upright walls or by headers within the roof construction.

The skylight described herein is characterized by improved energy performance; thermal air and weather tightness, simplicity of installation; good weathering properties; and enhanced durability.

The skylight construction shown herein includes a pair of glazing panels 16 and 18, a base frame 14, an operating leaf frame 20, and a retainer 22. The two frames 14 and 20 are constructed of a rigid PVC material and these frames ar individually coextruded. The retainer 22 is preferably constructed of a lightweight metal material such as aluminum.

Each of the frames 14 and 20 is constructed by a coextrusion process in which a flexible gasket such as gasket 44 is coextruded with a rigid frame section. At the corner miters, both the rigid and the flexible part of the frames are joined by a technique such as a heat platen sealing technique. This technique commonly joins the rigid frame sections at the corner miters while at the same time joining the gaskets for providing a continuous seal about the entire skylight curb frame construction.

The base frame 14 may also be referred to as a fixed leaf, while the support frame 20 may also be referred to as the overlying operating leaf. The base frame 14 has internal compartments 24 and 26 and has associated therewith a peripheral sealing flange 28. As indicated, for example, in FIG. 2, the flange 28 interlocks with the base frame 14 and receives a piece of roofing such as the roofing shingle 10 illustrated in FIG. 2. Also refer to FIG. 1 for a clear showing of the manner in which the shingles 10 cooperatively interengage with the sealing flange 28. For further details on the construction and associated function of the sealing flange 28, refer to the assignee's U.S. Pat. No. 4,702,049, granted Oct. 27, 1987.

To secure the skylight, and in particular the base frame 14 thereof, in place on the roof, there are provided a plurality of securing clips 11, each having one end 11*a* for securing the clip to the roof construction and another end 11*b* received by the base frame 14 at the recess 12, as illustrated in FIG. 2. A series of these securing clips 11 may be disposed about all sides of the base frame 14. As illustrated in FIG. 2, the securing clip 11 at its end 11*a* is substantially flat and preferably has two holes for receiving roofing nails. The opposite end 11*b* of the securing clip 11 has a stepped construction to enable the securing clip to interlock in the recess 12 in the base frame 14.

The skylight glazing plates 16 and 18 are supported over the support frame 20 by means of the retainer 22. The plate 16 and 18 are supported by a glazing frame 19. On the outer periphery of the frame 19 between the plates 16 and 18 there is a gasket 17. The gasket 17 may be of a premolded butyl material. As illustrated in FIG. 2, the frame 19 may be comprised of separate metal spacers with an outer seal comprising a chemically curable two-part polysulfide.

The lower glazing plate 18 rests upon a cup shaped sealing gasket 44 which is coextruded with the support frame 20. In FIG. 2, the gasket 44 is shown in its compressed position. The operating leaf or support frame 20 also includes means defining a channel 54 for receiving a securing bolt 56. The channel 54 is preferably threaded to receive the bolt 56. There are actually a plurality of these securing bolts or screws that are employed for securing the retainer 22 over the glazing plates 16 and 18. Two of the securing bolts 56 are shown in the perspective view of FIG. 1, each having associated therewith a cushion member 25. The securing bolt 56 actually passes through the glazing securing member 25, forming a cushioning for the edges of the glazing plates to prevent damage thereto, as well as to facilitate positioning thereof.

The retainer 22 has a top leg 34 and a side leg 36. The retainer 22 is generally of L-shaped construction. At the bottom end of leg 36 there is provided a pair of walls defining an interlocking channel 37 for receiving one end 38 of the header gasket 40. The other end 39 of the header gasket 40 is received within an interlocking channel 41 formed in the base frame 14. In FIG. 2 the header gasket 40 is shown in the closed position of the skylight with the header gasket thus in its more elongated form.

The top leg 34 of the retainer 22 is also adapted to receive a gasket, illustrated in FIG. 2 as the relatively flat gasket 42 that is interlocked with the very free end of the leg 34. The gasket 42 may be constructed of a premolded butyl material and is adapted to engage with and securely hold the top of the glazing plates, contacting the plate 16 as illustrated in FIG. 2. The top leg 34 also has a depending wall 35 for engagement by the glazing cushion member 25. The leg 34 also includes a slot 43 for receiving a leg of the glass cushion member 25.

As indicated previously, the particular skylight construction depicted herein is in the form of a two part curb frame with an operating frame added overlying a base frame. For the purpose of opening the operating frame, there are provided hinges 50, one on either side of the skylight. The cut-away perspective view of FIG. 1 shows the hinge 50 having associated therewith a pivot pin 51 and rivets 52. FIG. 2 also shows, in dotted outline, tee hinge 50 and the placement of the pop rivets at 52. FIG. 2 also shows, in dotted outline, the pivot pin 51. The pin 51 is adapted to be retained in the channel 55 of the base frame 14. The overlying leaf frame 20 has a peripherally disposed channel 57 and along the sides thereof, the hinge 50 is pop riveted to the frame 20 while the hinge 50 is maintained in this channel 57.

Regarding the base frame 14, as indicated previously, it includes compartments 24 and 26, recess 12 for receiving the securing clip 11, and channels for receiving the pivot pin 51 and the header gasket 40. The base frame 14 also is provided with a condensation gutter 60 and furthermore supports at its top wall 62 the gasket 64. The gasket 64 is constructed to provide multiple sealing points. The gasket 64 is generally of cylindrical construction but is provided with separately disposed ears such as the ears 65 and 66 illustrated in FIG. 2. FIG. 2 clearly illustrates the multiple sealing points of the gasket 64. It is also noted that multiple sealing points are provided not only at the wall 62 but also at the wall 67 of the overlying leaf frame 20. In FIG. 2 the gasket 64 is shown in partially compressed position and providing an effective watertight seal between the separate curb frame sections.

Reference has been made hereinbefore to the bolt 56 as it relates to securing the retainer to the curb frame. As noted in FIG. 2, the bolt 56 preferably passes not only through the threaded channel 54 in wall 68 of the frame 20, but also through the wall 69. In other words, the securing bolt 56 actually penetrates two walls of the frame 20. This adds further stability to the overall skylight construction, particularly as it relates to the retaining of the glazings.

FIG. 2 shows a part of the building construction, including building members 70, which may be of wood construction such as typical 2×4s or 2×6s. FIG. 2 shows the roofing nails 71 used through the securing clip 11 and driven into the members 70. There is also illustrated in FIG. 2 a gypsum board 72 associated with the base frame 14. This is a typical building construction that can be used and that is associated with the skylight.

Figure 3:
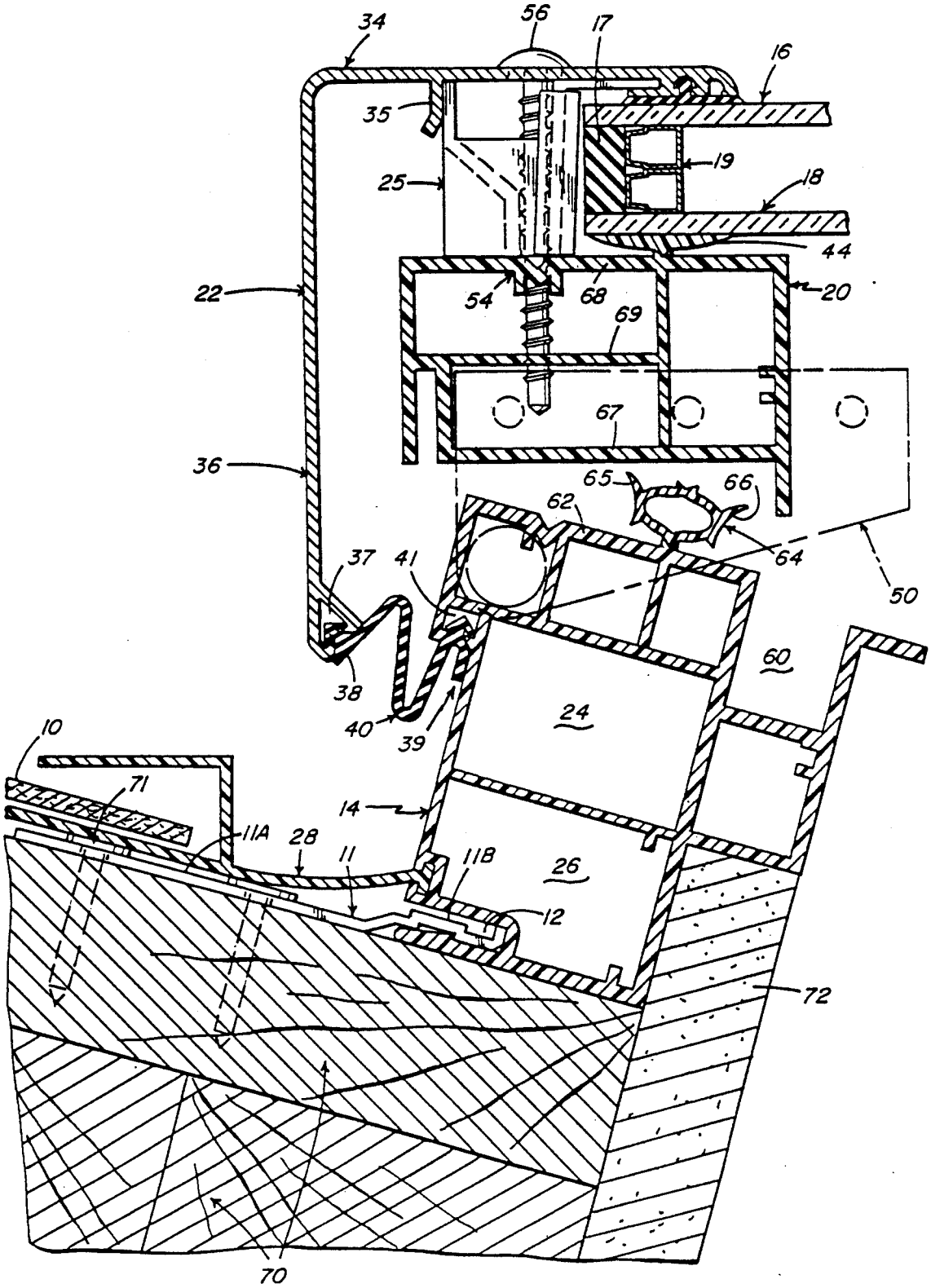
FIG. 3 is a cross-sectional view similar to the cross-sectional view of FIG. 2 but illustrating the skylight in an opened position.

Reference is now made to FIGS. 3–6 herein for further details of the header gasket construction as in accordance with the present invention. FIG. 3 is a cross-sectional view substantially the same as the cross-sectional view of FIG. 2 but illustrating the overlying operating leaf 20 pivoted to at least a partially open position. This view has been shown to illustrate the manner in which the header gasket 40 at its folded section can compress and essentially fold so as to readily accommodate movement between the base frame 14 and the overlying frame 20. Thus, the header gasket described herein is one that is constructed so that it is expandable in length.

FIG. 4 is a cross-sectional view taken along line 4—4 of FIG. 2. FIG. 4 illustrates the header gasket 40 as extending from miter corner to miter corner at miters M. The gasket 40 is shown with squared ends, and that is the preferred form of construction.

FIGS. 5 and 6 are enlarged views of the header gasket construction. FIG. 5 shows the same gasket as previously depicted in FIG. 3. FIG. 6 shows an alternate construction for the gasket. In FIG. 5, the end 38 as well as the end 39 has an arrow member A. The arrow A at end 38 is adapted to be accommodated in the interlocking recess 37. It is noted that the arrow A is directed at a 45° angle. The arrow A is adapted for being accommodated in the interlocking recess 41 of the base frame 14. Between the ends 38 and 39 there is a folding section that includes two bends B.

The version of FIG. 6, instead of including two bends, includes only a single bend B1. The gasket 40A in FIG. 6 has, in addition to its center folding section, also ends 38A and 39A. Each of these ends has an arrow A1. The retainer leg 36 in this version has a recess 37A for receiving the arrow A1. Similarly, the base frame 14 has a recess 41 for receiving the arrow A1 in an interlocking position. It is noted in the version of FIG. 6 that both of the arrows A1 are directed in the same direction, while in the version of FIG. 5 the arrows A are disposed at 45° to each other.

In all of the embodiments of the header gasket described herein, it is noted that the gasket itself is made of a relatively flexible PVC material. The retaining recesses for the ends of the gasket are constructed in a rigid form. The interlocking arrows A and A1 are adapted to easily deflect when forced into their accommodating recesses. FIG. 5 shows the gasket separate from the recesses. FIG. 6 shows the gasket with the arrows being forced into the recesses and interlocked therewith.

Having now described a limited number of embodiments of the present invention, it should now become apparent to those skilled in the art that numerous other embodiments and modifications are contemplated as falling within the scope of the present invention, as defined by the appended claims. For example, the gasket of the invention can be employed in connection with either single piece or two piece curb frames. The gasket may be used on a fixed position single piece curb frame.

What is claimed is:

1. A skylight construction for an opening in a building or the like comprising: a frame means extending about the opening and including means securable about the opening, translucent or transparent means covering the opening and extending at edges to overlie the frame means, means for retaining the covering means on the frame means, said frame means comprising a base frame and a support frame overlying the base frame, both said base frame and said support frame constructed of a rigid plastic material, said base and support frames having associated therewith at least one flexible gasket adapted to be positioned therebetween, and a foldable gasket means having opposite ends each being provided with insertable interlocking means and extending along at least one side of the frame means, said means for retaining and said base frame each having retaining interlock means for receiving the insertable interlocking means at the respective ends of said foldable gasket means.

2. A skylight construction as set forth in claim 1, including a further gasket extending from the support frame and disposed between the support frame and the covering means.

3. A skylight construction as set forth in claim 1 including hinge means between the base frame and support frame.

4. A skylight construction as set forth in claim 1 wherein said covering means includes at least one plate means.

5. A skylight construction as set forth in claim 4 wherein said covering means includes a pair of glazing plates.

6. A skylight construction as set forth in claim 1 wherein said retaining means includes a retainer having one side extending downwardly toward the base frame and another side extending inwardly to contact the edge of the covering means.

7. A skylight construction as set forth in claim 1 including a cup-shaped gasket carried by the support frame and upon which the covering means rests.

8. A skylight construction as set forth in claim 1 wherein said retaining interlock means includes two interlocking recesses, one on the retaining means and the other on the base frame.

9. A skylight construction as set forth in claim 8 wherein each end of the gasket has an arrow-shaped means for interlocking in the recess.

10. A skylight construction as set forth in claim 9 wherein the foldable gasket means between its ends includes at least one bend to enable the foldable gasket means to expand in length between its ends.

11. A skylight construction as set forth in claim 10 wherein the foldable gasket means has a plurality of bends.

12. A skylight construction as set forth in claim 11 wherein the arrow-shaped members at the ends of the foldable gasket means extend in different directions.

13. A skylight construction as set forth in claim 12 wherein the arrows extend at a difference of 45°.

14. A skylight construction for an opening in a building or the like comprising: a frame means extending about the opening and including means securable about the opening, translucent or transparent means covering the opening and extending at edges to overlie the frame means, means for retaining the covering means on the frame means, said frame means comprising a curb frame, said means for retaining comprising a retainer, and a foldable gasket means having opposite ends each being provided with insertable interlocking means and extending along at least one side of the curb frame, said retainer and said curb frame each having retaining interlock means for receiving the insertable interlocking means at the respective ends of said foldable gasket.

15. A skylight construction as set forth in claim 14 wherein said retaining interlock means includes two interlocking recesses, one on the retaining means and the other on the base frame.

16. A skylight construction as set forth in claim 15 wherein each end of the gasket has an arrow-shaped means for interlocking in the recess.

17. A skylight construction as set forth in claim 16 wherein the foldable gasket means between its ends includes at least one bend to enable the foldable gasket means to expand in length between its ends.

18. A skylight construction as set forth in claim 17 wherein the foldable gasket means has a plurality of bends.

19. A skylight construction as set forth in claim 18 wherein the arrow-shaped members at the ends of the foldable gasket means extend in different directions.

20. A skylight construction as set forth in claim 19 wherein the arrows extend at a difference of 45°.

21. A skylight construction for an opening in a building or the like comprising: a frame means extending about the opening and including means securable about the opening, translucent or transparent means covering the opening and extending at edges to overlie the frame means, means for retaining the covering means on the frame means, said frame means comprising a base frame and a support frame overlying the base frame and being articulatable with respect thereto, both said base frame and said support frame constructed of a rigid plastic material, said base and support frames having associated therewith at least one flexible gasket adapted to be positioned therebetween, and a gasket means so configured as to be both foldable and extendable having opposite ends each being provided with insertable interlocking means and extending along at least one side of the frame means, said means for retaining and said base frame each having retaining interlock means for receiving the insertable interlocking means at the respective ends of said foldable gasket means.

22. The skylight construction of claim 21 wherein said retaining interlock means includes two interlocking recesses, one on the retaining means and the other on the base frame, each end of the gasket has an arrow-shaped means for interlocking in the recess, and the foldable gasket means between its ends includes at least one bend to enable the foldable gasket means to expand in length between its ends.

23. A skylight construction as set forth in claim 22 wherein the foldable gasket means has a plurality of bends.

24. The skylight construction of claim 22 wherein the arrow-shaped members at the ends of the foldable gasket means extend in the same direction.

25. A skylight construction as set forth in claim 22 wherein the arrow-shaped members at the ends of the foldable gasket means extend in different directions.

26. A skylight construction for an opening in a building or the like comprising: a frame means extending about the opening and including means securable about the opening, translucent or transparent means covering the opening and extending at edges to overlie the frame means, means for retaining the covering means on the frame means, said frame means comprising a curb frame, said means for retaining comprising a retainer, and a foldable gasket means having opposite ends each including securing means, said gasket means extending along at least one side of the curb frame, said retainer and said curb frame each having respective retaining means for receiving said respective securing means so as to anchor both ends of the gasket.

* * * * *